US011341803B2

(12) United States Patent
Fong et al.

(10) Patent No.: US 11,341,803 B2
(45) Date of Patent: May 24, 2022

(54) GAMING SYSTEM AND A METHOD OF GAMING

(71) Applicant: Aristocrat Technologies Australia Pty Limited, North Ryde (AU)

(72) Inventors: Colin Fong, Penshurst (AU); Steven Johnson

(73) Assignee: Aristocrat Technologies Australia Pty Limited, North Ryde (AU)

( * ) Notice: Subject to any disclaimer, the term of this patent is extended or adjusted under 35 U.S.C. 154(b) by 185 days.

(21) Appl. No.: 16/706,379

(22) Filed: Dec. 6, 2019

(65) Prior Publication Data

US 2020/0151999 A1 May 14, 2020

Related U.S. Application Data

(63) Continuation of application No. 15/266,790, filed on Sep. 15, 2016, now Pat. No. 10,504,318, which is a continuation of application No. 13/685,344, filed on Nov. 26, 2012, now abandoned, which is a continuation of application No. 11/866,198, filed on Oct. 2, 2007, now Pat. No. 8,337,293.

(30) Foreign Application Priority Data

Nov. 1, 2006 (AU) ..... 2006906074

(51) Int. Cl.
*G07F 17/34* (2006.01)
*G07F 17/32* (2006.01)

(52) U.S. Cl.
CPC ..... *G07F 17/3213* (2013.01); *G07F 17/3225* (2013.01); *G07F 17/3244* (2013.01); *G07F 17/3265* (2013.01); *G07F 17/3267* (2013.01); *G07F 17/34* (2013.01)

(58) Field of Classification Search
CPC ..... G07F 17/3213; G07F 17/3225; G07F 17/3244; G07F 17/3265; G07F 17/34
See application file for complete search history.

(56) References Cited

U.S. PATENT DOCUMENTS 5,833,537 A 11/1998 Barrie
6,270,412 B1 8/2001 Crawford et al.
(Continued)

OTHER PUBLICATIONS

Examiner's first report on Australian patent application No. 2007219354, dated Jan. 20, 2009.

(Continued)

*Primary Examiner* — Corbett B Coburn
(74) *Attorney, Agent, or Firm* — McAndrews, Held & Malloy, Ltd.

(57) ABSTRACT

A gaming system is disclosed which comprises a plurality of reels, each reel comprising a plurality of symbols from a set of symbols, a symbol selector arranged to select a plurality of symbols from each reel for display, a reel selector arranged to select at least one reel, a function allocator arranged to allocate a function to at least one selected reel such that each displayed symbol on said at least one selected reel acquires the function, and a game outcome generator arranged to determine a game outcome based on the displayed symbols and on the function allocated to said at least one selected reel. A corresponding method of gaming is also disclosed.

20 Claims, 8 Drawing Sheets

(56) References Cited

U.S. PATENT DOCUMENTS

| | | | | |
|---|---|---|---|---|
| 6,311,976 | B1 * | 11/2001 | Yoseloff | G07F 17/34 273/138.2 |
| 6,811,486 | B1 | 11/2004 | Luciano, Jr. | |
| 6,902,481 | B2 | 6/2005 | Breckner et al. | |
| 7,530,892 | B2 | 5/2009 | Jordan et al. | |
| 7,867,077 | B2 | 1/2011 | Baerlocher et al. | |
| 8,337,293 | B2 | 12/2012 | Fong et al. | |
| 2002/0175466 | A1 | 11/2002 | Loose et al. | |
| 2003/0013517 | A1 | 1/2003 | Bennett et al. | |
| 2003/0157978 | A1 | 8/2003 | Englman | |
| 2004/0033827 | A1 * | 2/2004 | Gilmore | G07F 17/3244 463/20 |
| 2004/0033829 | A1 | 2/2004 | Pacet et al. | |
| 2004/0214628 | A1 | 10/2004 | Boyd et al. | |
| 2005/0054420 | A1 | 3/2005 | Cregan et al. | |
| 2005/0068881 | A1 | 3/2005 | Kimura | |
| 2006/0068881 | A1 | 3/2006 | Casey | |
| 2006/0264254 | A1 | 11/2006 | Aoki | |
| 2007/0087805 | A1 | 4/2007 | Taylor | |
| 2007/0218991 | A1 | 9/2007 | Okada | |
| 2008/0039176 | A1 | 2/2008 | Okada | |
| 2008/0051181 | A1 | 2/2008 | Okada | |
| 2008/0076520 | A1 | 3/2008 | Chan et al. | |
| 2008/0108411 | A1 | 5/2008 | Jansen et al. | |
| 2009/0131145 | A1 | 5/2009 | Aoki et al. | |
| 2009/0221344 | A1 | 9/2009 | Fong et al. | |
| 2010/0016061 | A1 | 1/2010 | Gomez et al. | |
| 2011/0111829 | A1 | 5/2011 | Joung | |
| 2013/0184052 | A1 | 7/2013 | Fong et al. | |
| 2013/0244751 | A1 | 9/2013 | Bennett et al. | |

OTHER PUBLICATIONS

Examiner's first report on Australian patent application No. 2009200239, dated Jun. 21, 2010.

Examination report No. 1 for Australian patent application No. 2018253603, dated Dec. 16, 2019.

* cited by examiner

GAMING SYSTEM AND A METHOD OF GAMING

RELATED APPLICATION(S)

This application is a continuation of application Ser. No. 15/266,790, filed on Sep. 15, 2016, which is a continuation of application Ser. No. 13/685,344, filed on Nov. 26, 2012, now abandoned, which is a continuation of application Ser. No. 11/866,198, filed on Oct. 2, 2007, now U.S. Pat. No. 8,337,293, which claims priority to Australian Patent Application No. 2006906074, having a filing date of Nov. 1, 2006, entitled "A Gaming System and a Method of Gaming," which are hereby incorporated by reference herein in their entireties.

BACKGROUND

The present invention relates to a gaming system and to a method of gaming.

It is known to provide a gaming system which comprises a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a graphical display device.

SUMMARY

In accordance with a first aspect of the present invention, there is provided a gaming system comprising: a plurality of reels, each reel comprising a plurality of symbols from a set of symbols; a symbol selector arranged to select a plurality of symbols from each reel for display; a reel selector arranged to select at least one reel; a function allocator arranged to allocate a function to at least one selected reel such that each displayed symbol on the reel acquires the function; and a game outcome generator arranged to determine a game outcome based on the displayed symbols and on the function allocated to the reel.

In one arrangement, each reel is a physical rotatable reel. In an alternative arrangement, each reel is a virtual reel displayable on a graphical display device.

In one arrangement, the gaming system is operable in normal game mode wherein the function allocator does not allocate a function to a reel, and special game mode wherein the function allocator allocates a function to a reel. The gaming system may comprise a set of first symbols used during normal game mode and a set of second symbols used during special game mode.

The gaming system may be arranged to commence special game mode either automatically, based on occurrence of a particular game outcome, based on a system event such as receipt of an instruction from a remote game server to commence special game mode, or in response to player input, for example in response to a player input received after a particular game outcome has occurred or after an instruction has been received to commence special game mode.

The function allocated to a reel may be a wild function, a scatter function, a repeat win function, a multiplier function, a jackpot function or a feature commencement function.

In one embodiment, the gaming system is arranged to implement a multilevel game, and the function allocator is arranged to allocate a function to at least one reel at each level of the multilevel game.

In one embodiment, the gaming system comprises a plurality of reel sequences, each reel sequence defining which at least one reel is allocated a function at each level of the multilevel game and the order in which the reels are allocated the function, and the gaming system is arranged to randomly select one of the reel sequences.

The gaming system may be implemented as a stand alone gaming machine or across a network.

The gaming system may be arranged such that during implementation of a multilevel game the function allocated to a reel is retained at each level of the game.

A reel that acquires a function may be provided with a visible or audible indicator that the reel has an associated function, for example by displaying a pictorial representation such as a representation of a monkey over the selected reel.

In accordance with a second aspect of the present invention, there is provided a method of gaming comprising: providing a plurality of reels, each reel comprising a plurality of symbols from a set of symbols; selecting a plurality of symbols from each reel for display; randomly allocating a function to a reel such that each displayed symbol on the reel acquires the function; and determining a game outcome based on the displayed symbols and on the function allocated to the reel.

In accordance with a fourth aspect of the present invention, there is provided a computer readable medium having computer readable program code embodied therein for causing a computer to operate in accordance with a gaming system comprising: a plurality of reels, each reel comprising a plurality of symbols from a set of symbols; a symbol selector arranged to select a plurality of symbols from each reel for display; a function allocator arranged to randomly allocate a function to a reel such that each displayed symbol on the reel acquires the function; and a game outcome generator arranged to determine a game outcome based on the displayed symbols and on the function allocated to the reel.

In accordance with a fifth aspect of the present invention, there is provided a data signal having computer readable program code embodied therein for causing a computer to operate in accordance with a gaming system comprising: a plurality of reels, each reel comprising a plurality of symbols from a set of symbols; a symbol selector arranged to select a plurality of symbols from each reel for display; a function allocator arranged to randomly allocate a function to a reel such that each displayed symbol on the reel acquires the function; and a game outcome generator arranged to determine a game outcome based on the displayed symbols and on the function allocated to the reel.

BRIEF DESCRIPTION OF THE DRAWINGS

The present invention will now be described, by way of example only, with reference to the accompanying drawings, in which.

DESCRIPTION OF AN EMBODIMENT

Figure 1:
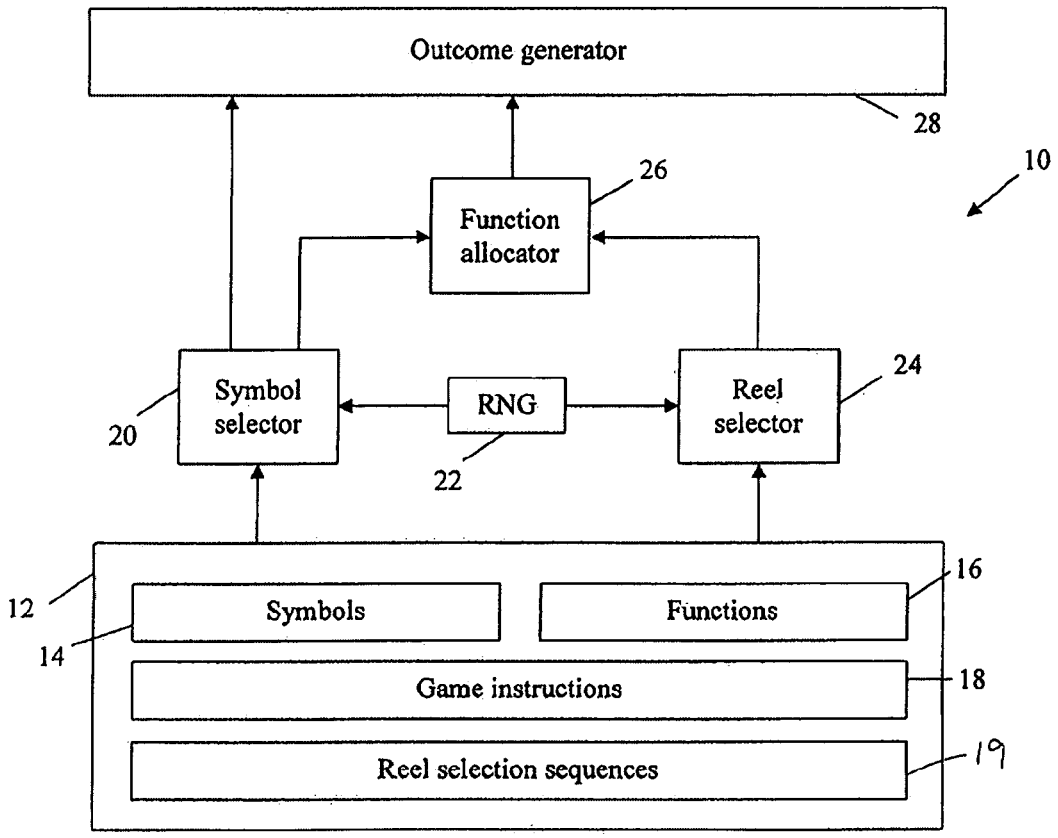
FIG. 1 is a diagrammatic block diagram of a gaming system in accordance with an embodiment of the present invention.

Referring to the drawings, there is shown a schematic block diagram of a gaming system 10 arranged to implement a probabilistic game of the type wherein several symbols from a set of symbols are randomly displayed on a plurality of reels, and a game outcome is determined on the basis of the symbols displayed on the reels. With some such probabilistic games, the set of symbols include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display in the same line, scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

The present gaming system operates such that at least during a portion of a game implemented by the gaming system at least one reel is selected and a function is allocated to each of the symbols displayed on the reel. The game outcome is determined based on the displayed symbols and the function allocated to the selected reel. In this way, the probability of occurrence of a win outcome is increased and thereby player interest in the game enhanced.

It will be understood that allocation of a function to a reel is not dependent on symbols appearing on a reel during a game; instead a reel to acquire a function is randomly or pseudo randomly selected irrespective of the symbols displayed on the reels.

Referring to FIG. 1, the gaming system 10 comprises a memory 12 arranged to store symbols data 14 indicative of a plurality of symbols for subsequent display to a player, function data 16 indicative of one or more functions allocatable to the symbols, and game instruction data 18 indicative of game instructions usable by the gaming machine 10 to control operation of the game.

In this embodiment, the memory 12 also includes reel selection sequences 19, each of which defines a reel selection pathway which determines the order in which specific reels will be selected during a multilevel game.

The gaming system 10 also includes a symbol selector 20 which is arranged to select several symbols for display to a player. In this example, the selection carried out by the symbol selector 20 is made using a random number generator 22.

It will be appreciated that the random number generator 22 may be of a type which is arranged to generate pseudo random numbers based on a seed number, and that in this specification the term "random" will be understood accordingly to mean truly random or pseudo random.

The gaming system 10 also comprises a reel selector 24 arranged to select one or more reels to which a function is to be applied, and a function allocator 26 arranged to select and allocate one or more functions to one or more selected reels. The function allocator 26 may be arranged to randomly select a function or to select a function on the basis of a predefined rule.

In the present embodiment, the reel selector 24 in association with the random number generator 22 selects one of the reel sequences 19 stored in the memory 12, the selected reel sequence 19 defining which reels will be selected in a multilevel special game and the order in which the reels will be selected. In this way, pseudo random selection of reels can be achieved whilst ensuring that desired win probability values are achieved, for example so as to ensure that the gaming system complies with relevant regulatory requirements.

The functions allocatable to a reel may include a wild function, a scattered function, a wild and scattered function, or any other suitable function.

The gaming system 10 also comprises an outcome generator 28 which in accordance with the game instructions 18 determines game outcomes based on the symbols selected for display to a player by the symbol selector 20, and on the basis of the function(s) allocated to one or more selected reels.

In the embodiments described below, the symbol selector 20, the reel selector 24, the function allocator 26, and the outcome generator 28 are implemented using a microprocessor and associated software, although it will be understood that other implementations are envisaged.

The gaming system 10 can take a number of different forms.

In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

With a thick client implementation, a data signal containing a computer program usable by the client terminal to implement the gaming system may be transferred from the game server to the client terminal, for example in response to a request by the client terminal.

Figure 2:
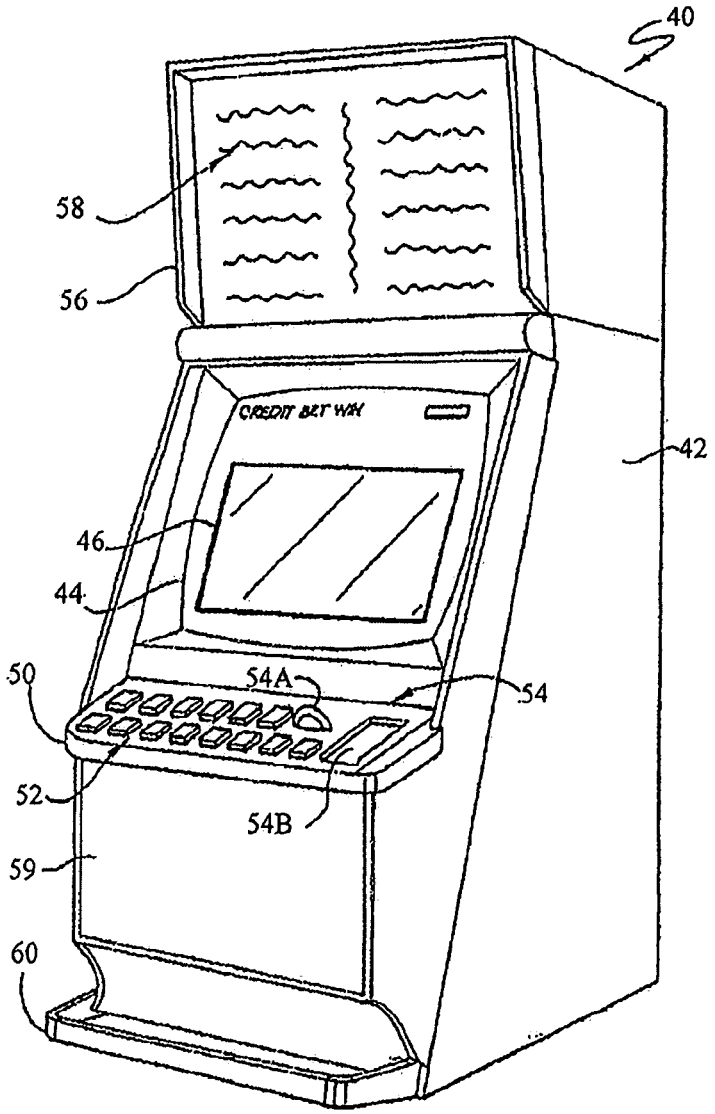
FIG. 2 is a diagrammatic representation of a gaming system in accordance with an embodiment of the present invention with the gaming system implemented in the form of a standalone gaming machine.

A gaming system in the form of a standalone gaming machine 40 is illustrated in FIG. 2. The gaming machine 40 includes a console 42 having a display 44 on which is displayed representations of a game 46 that can be played by a player. A mid-trim 50 of the gaming machine 40 houses a bank of buttons 52 for enabling a player to interact with the gaming machine, in particular during gameplay. The mid-trim 50 also houses a credit input mechanism 54 which in this example includes a coin input chute 54A and a bill collector 54B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 56 may carry artwork 58, including for example pay tables and details of bonus awards and other information or images relating to the game. Further artwork and/or information may be provided on a front panel 59 of the console 42. A coin tray 60 is mounted beneath the front panel 59 for dispensing cash payouts from the gaming machine 30.

The display 44 is in the form of a video display unit, particularly a cathode ray tube screen device. Alternatively, the display 44 may be a liquid crystal display, plasma screen, or any other suitable video display unit. The top box 56 may also include a display, for example a video display unit, which may be of the same type as the display 44, or of a different type.

The display 44 in this example is arranged to display representations of several reels, each reel of which has several associated symbols. Typically 3, 4 or 5 reels are provided. During operation of the game, the reels first appear to rotate then stop with typically three symbols visible on each reel. Game outcomes are determined on the basis of the visible symbols together with any special functions associated with the symbols, and if a function has been allocated to a reel, on the basis of the allocated function.

It will be understood that instead of providing a video display unit which displays representations of reels, physical reels may be used. Such gaming machines including actual rotatable reels are commonly termed stepper machines.

A stepper machine typically has a separate motor for each reel, and the game controller of such a gaming machine has a stop determining function that determines the stop position for each reel. For example, if there are five reels, each having twenty symbols, the stop determining function might determine that the stop positions are positions 3, 13, 7, 9 and 17. When a reel stops, the symbols will be in one of a plurality of possible symbol positions for that reel relative to the stop position.

Figure 3:
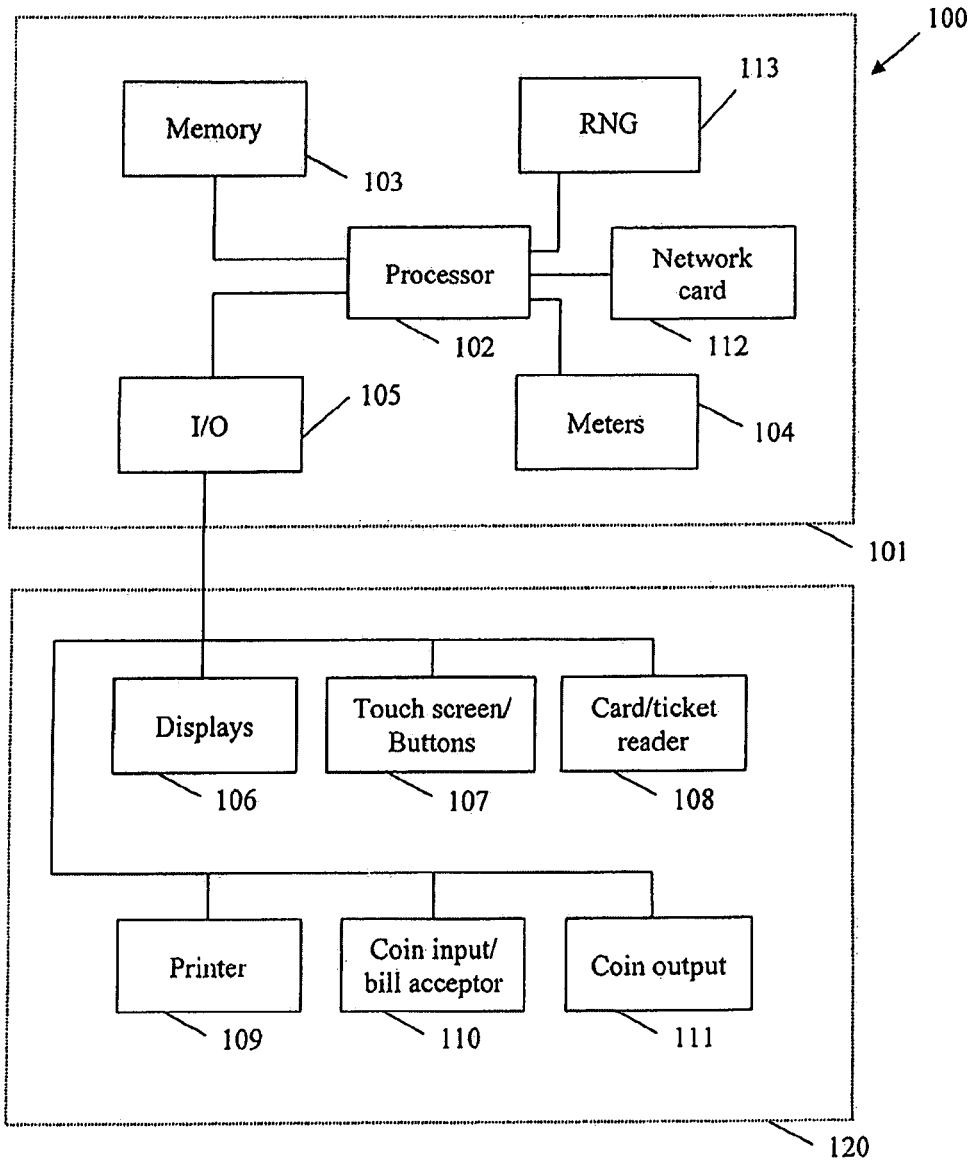
FIG. 3 is a schematic block diagram of operative components of the gaming machine shown in FIG. 2.

FIG. 3 shows a block diagram of operative components of a typical gaming machine 100 which may be the same as or different to the gaming machine shown in FIG. 2.

The gaming machine 100 includes a game controller 101 having a processor 102. Instructions and data to control operation of the processor 102 in accordance with the present invention are stored in a memory 103 which is in data communication with the processor 102. The gaming machine 100, and in particular the processor 102 and the memory 103, implement the gaming system 10 shown schematically in FIG. 1.

Typically, the gaming machine 100 will include both volatile and non-volatile memory and more than one of each type of memory, with such memories being collectively represented by the memory 103.

Figure 4:
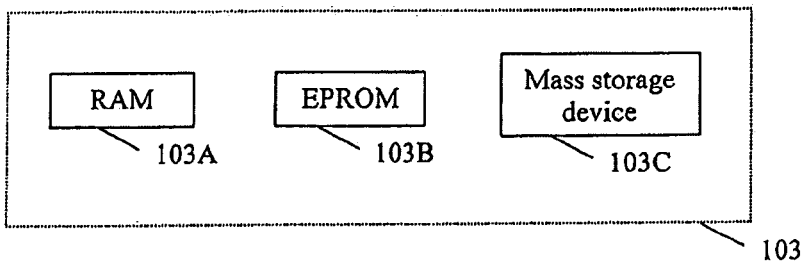
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (VO) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 3, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106, 107, 108, 109, 110, 111 may be provided remotely from the game controller 101.

Figure 5:
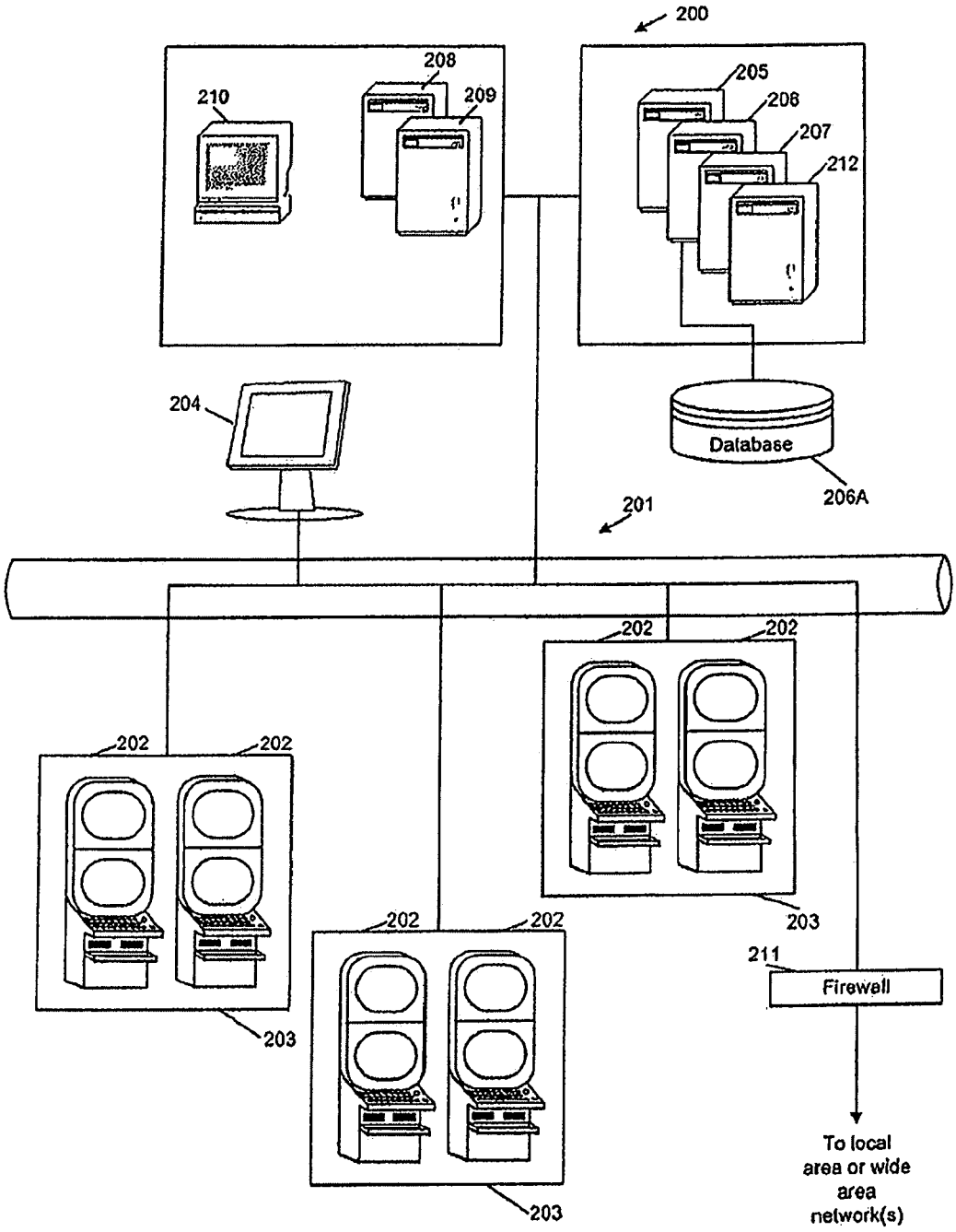
FIG. 5 is a schematic diagram of a gaming system in accordance with an alternative embodiment of the present invention with the gaming system implemented over a network.

FIG. 5 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game. A loyalty program server 212 may also be provided.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. pes running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

During operation, the game controller, whether implemented in a standalone gaming machine 10, 100 or over a network 201, implements a probabilistic game wherein at least during part of the game the probability of occurrence of a win outcome is increased by allocating a function to one or more of the reels.

Examples of specific implementations of the gaming system will now be described in relation to a standalone gaming machine 10, 100 although it will be understood that implementation may also be carried out using other gaming system architectures such as a network architecture of the type shown in FIG. 5.

In one embodiment, the gaming system is operable in normal game mode and special game mode.

During normal game mode, reels comprising standard symbols and optionally one or more function symbols are provided. Win outcomes are determined on the basis of the symbols visible when the reels stop rotating, and in this example three symbols are displayed on each reel at any time. A win outcome may occur based on display of the same symbol along a horizontal or diagonal line, as scattered symbols, or in any other predefined way. A win outcome may also occur on the basis of one or more standard symbols in combination with at least one function symbol having a predetermined assigned function. For example a function symbol may correspond to a wild function, a scatter function, a multiply function, a repeat win function, and so on.

During special game mode, a new function is allocated to each symbol on a selected reel that is used in determining a game outcome, typically the visible symbols. In a multilevel game, a function may additionally be allocated to a different reel at each level of the game.

For example, in a first game, a first function may be allocated to a first reel, and in a second successive game a second function may be allocated to a second reel such that during the second game two reels have an allocated function.

It will be understood that with this embodiment a function is allocated to a reel only when the gaming system operates in a special game mode. However, other arrangements are envisaged. For example, the gaming system may be arranged so as to operate in only one mode and to allocate a function to a reel during normal game operation.

The gaming system may be arranged to commence special game mode when predetermined game outcomes occur and special game mode may comprise one or more free games, in this example three free games. Special game mode may commence automatically on the basis of a game event occurring during a game, based on game outcomes determined by the gaming system, or may be prompted by a player pressing a button on the gaming system 10 after the player has identified that a game outcome corresponding to special game mode requirements has occurred.

The gaming system 10, 100 may also be arranged so as to determine eligibility for special game mode, for example based on the amount or type of bet placed, based on certain time periods and so on.

Figure 6:
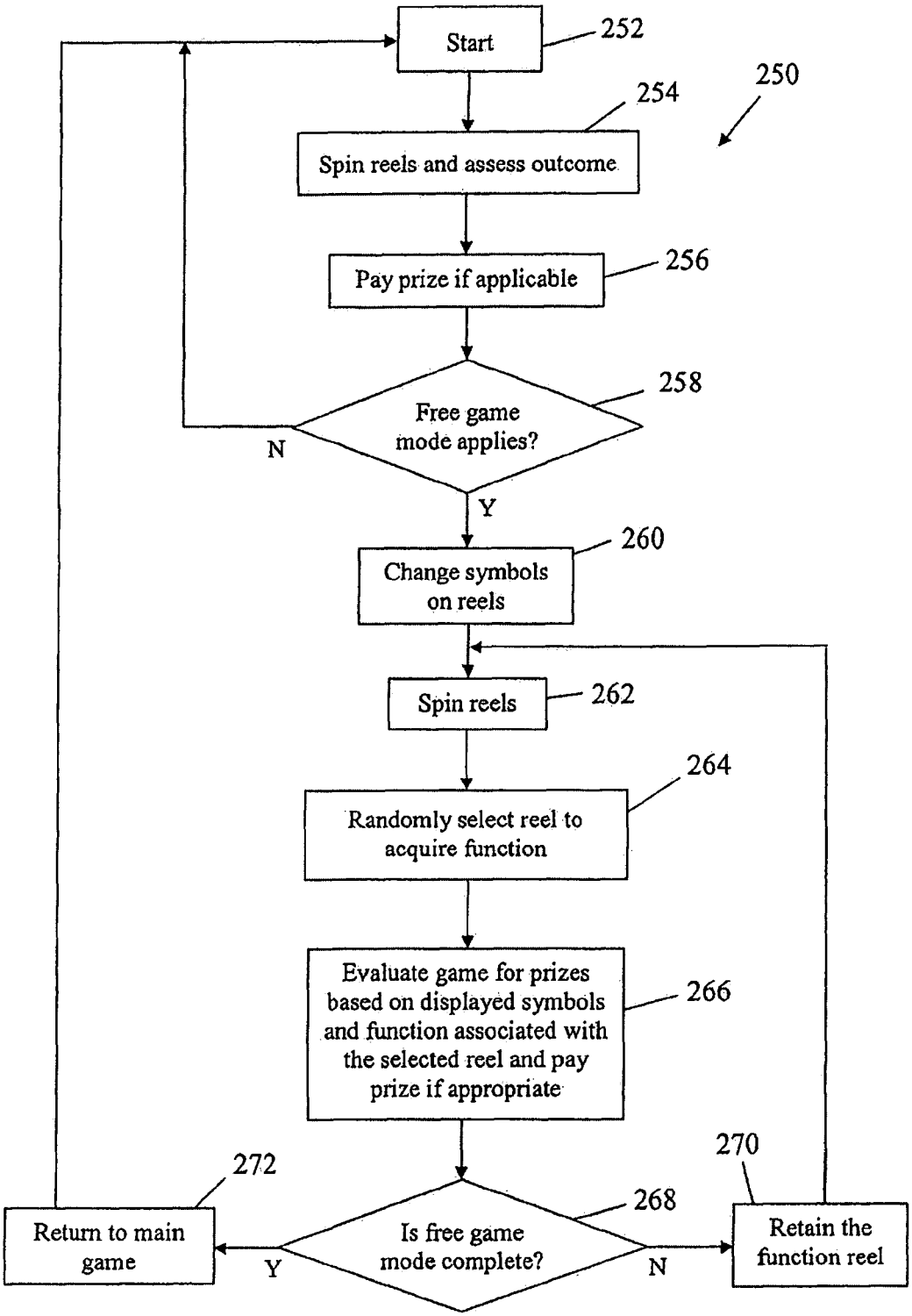
FIG. 6 is a flow diagram illustrating game play of a gaming system in accordance with an embodiment of the present invention.

A specific example will now be described in relation to flow diagram 250 shown in FIG. 6 which illustrates steps 252 to 272 of a method of gaming implemented by the gaming system according to the present embodiment.

Figure 7:
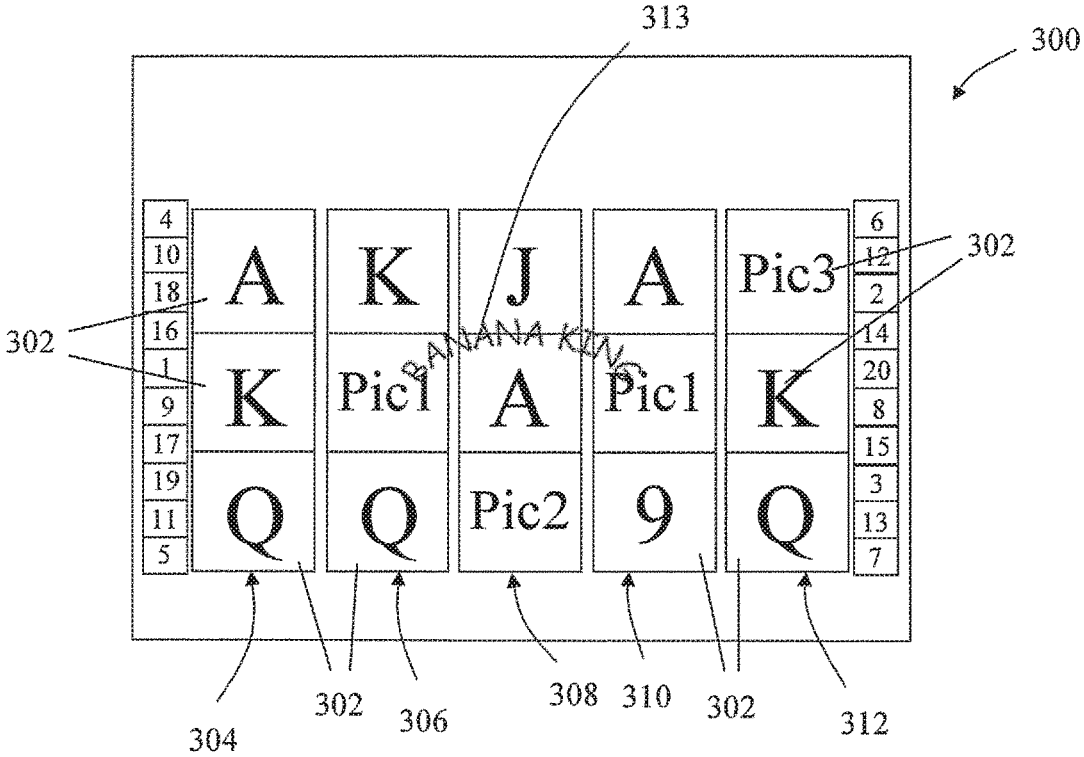
FIGS. 7 to 11 are diagrammatic representations of example screen views of a gaming system in accordance with an embodiment of the present invention during implementation of a game.

In this example, five reels are provided, with each reel having multiple symbols. The reels are virtual reels and, as such, representations of the reels are displayed on a graphical display device 44. An example representation 300 shown on the display device 44 is shown in FIG. 7.

The gaming system 10, 100 is operable in normal game mode and special game mode. During normal game mode, symbols 302 disposed on first, second, third, fourth and fifth reels 304, 306, 308, 310, 312 as shown in FIG. 7 are used. Win outcomes are determined on the basis of the displayed symbols 302 according to predetermined win lines which may be horizontal, diagonal or in any other predetermined patterns.

When a predetermined condition occurs during normal game mode, for example based on occurrence of predetermined game outcomes, by a player pressing a button after the player has identified that requirements for special game mode have been met, or in any other way, the gaming system 10, 100 implements special game mode. Commencement of special game mode may be communicated to a player in any suitable way, for example by displaying an icon 313 on the graphical display.

Figure 8:
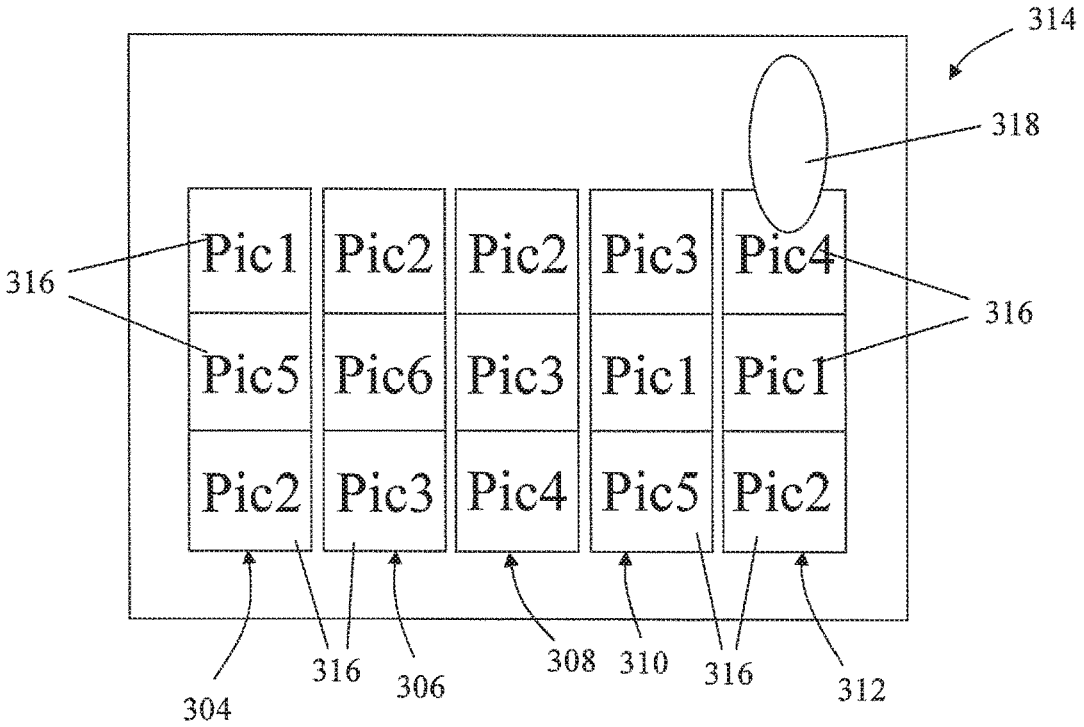

During special game mode, an alternative representation 314 is displayed by the display device 44, as shown in FIG. 8. In this example, special game mode uses alternative symbols 316 and winning outcomes are determined on the basis of alternative symbols 316 appearing in predetermined patterns having one symbol from the pattern in each reel.

However, it will be understood that the symbols used during normal game mode may also be used during special game mode if desired.

In the present example, three consecutive free games are played, although it will be understood that other implementations are possible.

During a first free game, the reels rotate and stop, and a marker, in this example in the form of a monkey animation 318 moves consecutively across the reels 304, 306, 308, 310, 312 and stops above one of the reels to indicate that the reel is selected to acquire a function. It will be understood that the position of the marker 318 relative to the reels is determined by the reel selector 24 which is implemented by the processor 102 in association with programs in the memory 103, and the random number generator 22. The selected reel may be identified using suitable graphical indicia, in this example by displaying a monkey 319 across the entire selected reel as shown in the representation 320 in FIG. 9. In the first free game, the first reel 304 is selected to acquire a function.

In this example, the function allocated to the selected reel 304 is a wild function and, accordingly, win outcomes are determined on the basis of the displayed alternative symbols 316 and the wild function allocated to the selected first reel 304. Each display position on the wild reel substitutes for all symbols, but only once per symbol. In the present example, a win outcome is deemed to occur if five of the same symbols are present.

Figure 9:
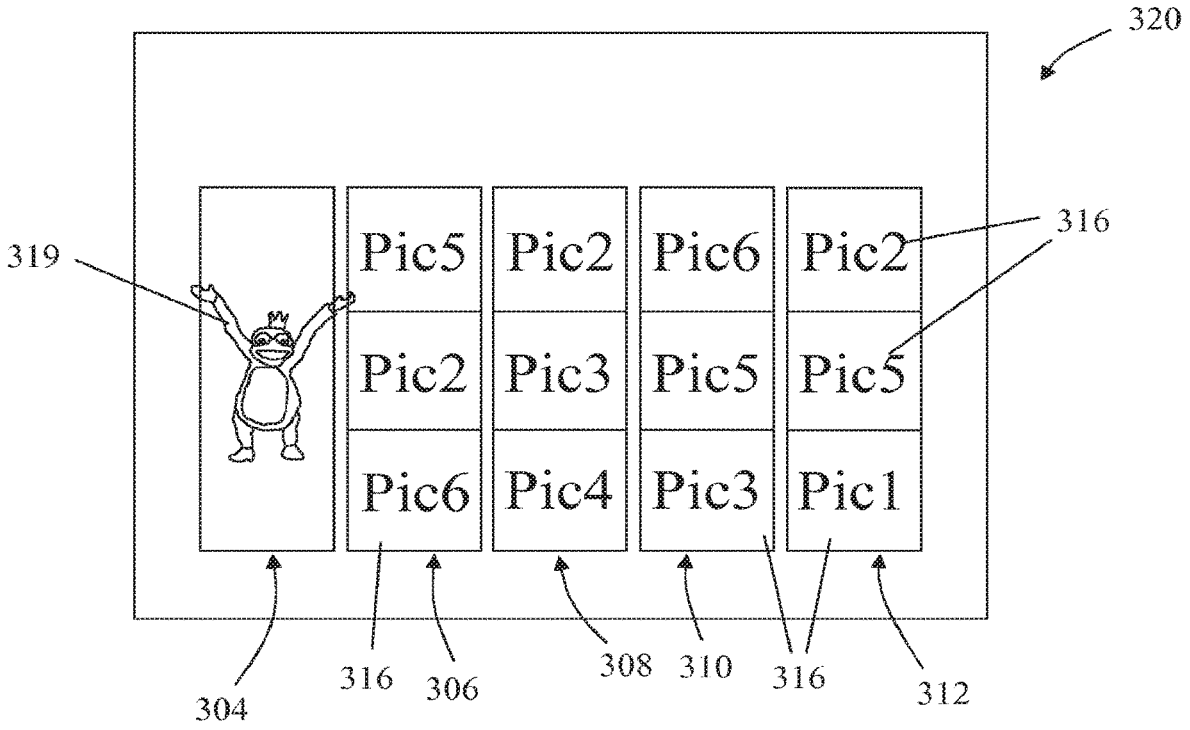

In the present example shown in FIG. 9, even with the first reel 302 acquiring a wild function, five of the same symbols do not occur and, accordingly, the outcome generator 28 implemented by the processor 102 in association with programs in the memory 103 determines that no prize is applicable for the first free game.

Figure 10:
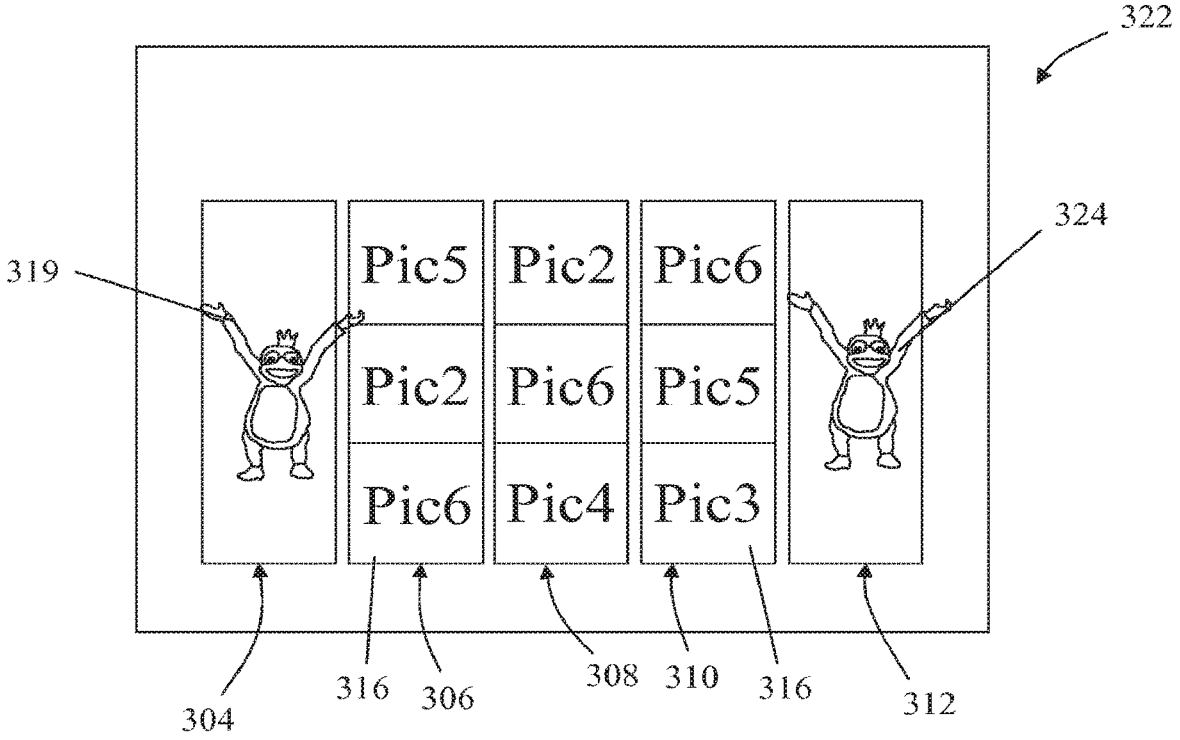
Figure 11:
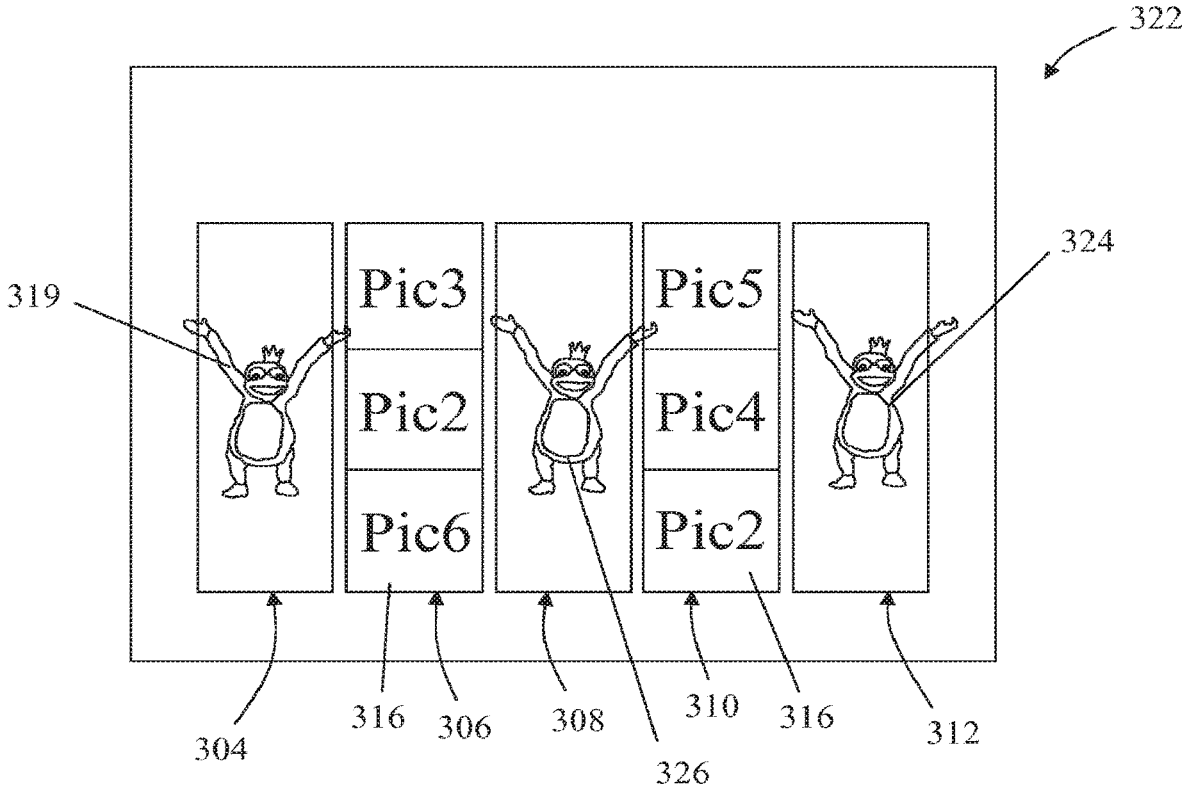

During a subsequent second free game, the reels are spun and subsequently stopped, the wild function allocated to the first reel 304 is retained, and a second reel to acquire a new function is selected in the same way as described above in relation to the first free game. In this example, as shown in the representation 322 shown in FIG. 10, the fifth reel 312 is selected to acquire a new function and a visible indication that the fifth reel has been selected is displayed over the fifth reel 312, in this example by displaying a monkey 324 across the entire selected fifth reel 312.

In this example, the function allocated to the selected fifth reel 312 is a wild function.

The game outcome is then determined by the outcome generator 28 based on the displayed alternative symbols 316 and on the wild functions allocated to the first and fifth reels 304, 312.

In the present example, a giraffe is displayed in each of the second, third and fourth reels 306, 308, 310 and, accordingly, the outcome generator 28 determines that a win outcome containing five giraffes in a line has occurred and an appropriate prize is provided to the player.

During a subsequent third free game, the reels are spun and subsequently stopped, the wild function allocated to the first and fifth reels 304, 312 is retained, and a third reel is selected to acquire a new function. As with the first and second free games, a visible indication that the reel has been selected is displayed over the third reel 308, in this example by displaying a monkey 326 over the third reel 308.

The game outcome is then determined by the outcome generator 28 and, in this example, since an armadillo is present in each of the second and fourth reels 306, 310, the outcome generator 28 determines that five armadillos are present in a line and an appropriate prize is paid to the player.

After completion of the third free game, special game mode ceases and the gaming system 10, 100 returns to normal game mode.

Modifications and variations as would be apparent to a skilled addressee are deemed to be within the scope of the present invention.

What is claimed is:

1. A gaming system for playing a multilevel feature game having a plurality of levels, the gaming system comprising:

a credit input operable to establish a credit balance;

a player interface operable to receive a player selection;

a display device; and a game controller comprising a processor and memory storing a) a set of symbols for a plurality of reels, and a plurality of reel sequences, each of the plurality of reel sequences defining 1) which of the plurality of reels is allocated a function at each level of the multilevel feature game and 2) an order in which the plurality of reels are allocated the function, and b) instructions, which, when executed, cause the game controller to at least:

initiate play of the multilevel feature game in response to a trigger condition, select a plurality of symbols from the set of symbols based on a random number generated by a random number generator in response to a received player selection via the player interface, randomly select a first reel sequence from the plurality of reel sequences, based on the random number generator, control the display device to display the plurality of symbols selected and to display a marker animation sequence visually moving across at least one or more of the plurality of reels and, when the marker animation sequence stops over a selected reel, indicating the selected reel of the plurality of reels is to acquire the function based on the first reel sequence selected, control the selected reel to acquire the function in each level of the multilevel feature game, and determine an outcome in each level of the multilevel feature game based at least in part on:

(1) the symbols selected, (2) the function acquired by the selected reel, and (3) a second function acquired by another reel in a preceding level.

2. The gaming system as claimed in claim 1, wherein the instructions, when executed, further cause the game controller to retain the function acquired by the selected reel such that during the multilevel feature game the function acquired by the selected reel is retained at each following level of the multilevel feature game.

3. The gaming system as claimed in claim 1, wherein the function acquired by the selected reel is a wild function, a scatter function, a repeat win function, a multiplier function, a jackpot function or a feature commencement function.

4. The gaming system as claimed in claim 1, wherein each reel is a virtual reel displayable on the display device.

5. The gaming system as claimed in claim 1, wherein the instructions, when executed, further cause the game controller not to allocate the function to the selected reel in a normal game mode, and to control the selected reel to acquire the function in a special game mode.

6. The gaming system as claimed in claim 5, wherein the memory further comprises a set of first symbols used during the normal game mode and a set of second symbols used during the special game mode.

7. The gaming system as claimed in claim 1, wherein the marker animation sequence provides an audible information to the selected reel that has acquired the function.

8. A method of gaming for use with a gaming machine for providing visual assistance to a player and acquiring a function via a marker animation sequence in a multilevel feature game having a plurality of levels, the gaming machine having a credit input operable to establish a credit balance, a player interface operable to receive a player selection, a game controller comprising a processor and memory storing a) a set of symbols for a plurality of reels, and a plurality of reel sequences, each of the plurality of reel sequences defining 1) which of the plurality of reels is allocated the function at each level of the multilevel feature game, and 2) an order in which the plurality of reels are allocated the function, and b) instructions, which, when executed, cause the game controller to at least initiate play of the multilevel feature game in response to a trigger condition, and a display device, the method comprising:

establishing the credit balance via the credit input;

selecting, by the game controller, a plurality of symbols from the set of symbols in response to a received player selection via the player interface based on a random number generated by a random number generator;

randomly selecting, by the game controller, a first reel sequence from the plurality of reel sequences for display based on the random number generator;

controlling, by the game controller, the display device to display the plurality of symbols selected and the marker animation sequence visually moving across at least one or more of the plurality of reels and, when the marker animation sequence stops over a selected reel, indicating the selected reel of the plurality of reels is elected to acquire the function based on the first reel sequence selected;

controlling, by the game controller, the selected reel to acquire the function in each level of the multilevel feature game; and determining, by the game controller, an outcome in each level of the multilevel feature game based on (1) the symbols selected, (2) the function acquired by the selected reel, and (3) a second function acquired by another reel in a preceding level.

9. The method as claimed in claim 8, further comprising retaining the function acquired by the selected reel at each following level of the multilevel feature game.

10. The method as claimed in claim 8, wherein the function acquired by the selected reel is a wild function, a scatter function, a repeat win function, a multiplier function, a jackpot function or a feature commencement function.

11. The method as claimed in claim 8, wherein the reels comprise a plurality of virtual reels displayable on the display device.

12. The method as claimed in claim 8, further comprising causing the game controller not to allocate the function to the selected reel in a normal game mode, and controlling the selected reel to acquire the function in a special game mode.

13. The method as claimed in claim 12, wherein the memory further comprises a set of first symbols used during the normal game mode and a set of second symbols used during the special game mode.

14. The method as claimed in claim 8, wherein the marker animation sequence provides an audible information to the selected reel that has acquired the function.

15. A method of providing visual assistance to a player on a graphical display device of a gaming machine and acquiring a function via a marker animation sequence in a multilevel feature game having a plurality of levels, the gaming machine having a credit input operable to establish a credit balance, a player interface operable to receive a player selection, a game controller comprising a processor and memory storing a) a set of symbols for a plurality of reels, and a plurality of reel sequences, each of the plurality of reel sequences defining 1) which of the plurality of reels is allocated the function at each level of the multilevel feature game, and 2) an order in which the plurality of reels are allocated the function, and b) instructions, which, when executed, cause the game controller to at least initiate play of the multilevel feature game in response to a trigger condition, and a display device, the method comprising:

displaying on the graphical display device a plurality of symbols selected from the set of symbols in response to a selection via the player interface;

displaying on the graphical display device the marker animation sequence visually moving consecutively across at least two or more of the plurality of reels and, when the marker animation sequence stops over a selected reel, indicating the selected reel of the plurality of reels is to acquire the function in a first reel sequence randomly selected from the plurality of reel sequences based on a random number generated by a random number generator;

displaying on the selected reel to acquire the function in each level of the multilevel feature game; and generating an outcome in each level of the multilevel feature game based on (1) the symbols selected, (2) the function acquired by the selected reel, and (3) a second function acquired by another reel in a preceding level.

16. The method as claimed in claim 15, further comprising retaining the function acquired by the selected reel at each following level of the multilevel feature game.

17. The method as claimed in claim 15, wherein the function acquired by the selected reel is a wild function, a scatter function, a repeat win function, a multiplier function, a jackpot function or a feature commencement function.

18. The method as claimed in claim 15, wherein the reels comprise a plurality of virtual reels displayable on the display device.

19. The method as claimed in claim 15, further comprising causing the graphical display device not to allocate the function to the selected reel in a normal game mode, and causing the selected reel to acquire the function in a special game mode.

20. The method as claimed in claim 15, wherein the marker animation sequence provides an audible information to the selected reel that has acquired the function.

* * * * *